United States Patent [19]

Daniels

[11] 4,361,368

[45] Nov. 30, 1982

[54] STORAGE UNIT

[76] Inventor: Phillip D. Daniels, 4797 Lake Bluff, West Bloomfield Township, Pontiac County, Mich. 38033

[21] Appl. No.: 180,345

[22] Filed: Aug. 22, 1980

[51] Int. Cl.[3] ..... A47F 5/08; A47G 29/00

[52] U.S. Cl. ..... 312/138 R; 312/138 A; 312/214; 312/245; 211/73

[58] Field of Search ..... 312/138 R, 138 A, 214, 312/304, 111, 245, 204; 211/71, 73, 88; 248/205 A

[56] References Cited

U.S. PATENT DOCUMENTS

| | | | |
|---|---|---|---|
| 1,016,982 | 2/1912 | Carpenter | 312/245 |
| 1,898,922 | 2/1933 | West | 312/138 A |
| 2,686,703 | 8/1954 | Nave et al. . | |
| 2,706,140 | 4/1955 | Hinkel . | |
| 2,764,461 | 9/1956 | Montgomery | 312/245 |
| 2,914,873 | 12/1959 | Brennan | 248/205 A |
| 3,182,809 | 5/1965 | Getoor | 211/88 |
| 3,227,502 | 1/1966 | Roberts . | |
| 3,341,026 | 9/1967 | Spitler | 312/138 R |
| 3,409,717 | 11/1968 | Nozaki | 312/138 R |
| 3,419,933 | 1/1969 | Gossen | 312/138 R |
| 3,603,657 | 9/1971 | Hassay | 312/138 A |
| 3,613,604 | 10/1971 | Butler . | |
| 3,807,822 | 4/1974 | Amore | 312/138 A |
| 3,945,491 | 3/1976 | Lindenbaum | 248/205 A |
| 4,094,416 | 6/1978 | Smith . | |
| 4,189,195 | 2/1980 | Turney et al. | 312/138 R |
| 4,294,498 | 10/1981 | Van Luit | 312/138 R |

FOREIGN PATENT DOCUMENTS

| | | | |
|---|---|---|---|
| 2405385 | 5/1979 | France | 312/138 R |

*Primary Examiner*—Victor N. Sakran
*Attorney, Agent, or Firm*—Hiram P. Settle

[57] ABSTRACT

A storage unit adapted for attachment to a plane support surface, such as a flush interior door. The unit is thermoformed to provide a pair of side rails spaced inwardly from planar edges and lying on either side of a central planar portion. The central planar portion is provided with vertically spaced horizontal ribs spanning the rails to provide shelf surfaces. The side rails extend from the top of the unit to the bottom, and the uppermost and lowermost ribs blend vertically into the upper and lower extremities of the unit to provide additional support when the plane edges and the plane central portions are adhesively secured to the support surface. The unit can be provided with sliding doors, towel bars, shelf retention means, and the like, if desired.

10 Claims, 7 Drawing Figures

STORAGE UNIT

BRIEF SUMMARY OF THE INVENTION

The present invention provides a storage unit adapted to be adhesively secured to the back of a flush interior door or to any other similar plane support surface. The storage unit of the present invention is thermoformed from a single sheet of thermoplastic material, and the unit is light in weight, compact in design, and easily inventoried and handled by retail establishments as a finished article of merchandise which need only be installed by a customer.

Structurally, the storage unit of the present invention is unique in that the thermoplastic sheet is deformed, as by vacuum forming or "thermoforming" from a single sheet of material to form a pair of vertically extending side rails which are coextensive with the unit vertically and which form the primary structural component of the unit. Transverse, horizontally disposed shelves are also integrally formed during the thermoforming operation to extend between the rails, thereby providing shelves upon which items maybe stored. The uppermost and the lowermost of the ribs have their surfaces facing the extremities of the unit formed to a concave configuration to provide tensile and compressive reinforcing portions which aid in transferring the load from the rails and the shelves to the support surface upon which the unit is mounted.

The unit may be provided with sliding doors, towel bars, shelf retention means and the like to promote its efficiency and utility as a storage unit for miscellaneous household goods such as cosmetics, cleaning supplies, towels, clothes, shoes, foodstuffs, and the like.

The rails are spaced transversely inwardly from the edges of the unit, thereby providing planar marginal strips, and large unrestricted sheet surface areas also exist intermediate the rails and the ribs. The reverse sides of these planar portions, as well as the extremities of the upper and lower ribs are adhesively secured to a support surface, for example by caulking material, to retain the storage unit in position, the entire perimeter of the unit and the major portion of its interior portions thus being adhesively secured to insure retention of the unit in position.

AS SHOWN ON THE DRAWINGS

THE PREFERRED EMBODIMENT

Figure 1:
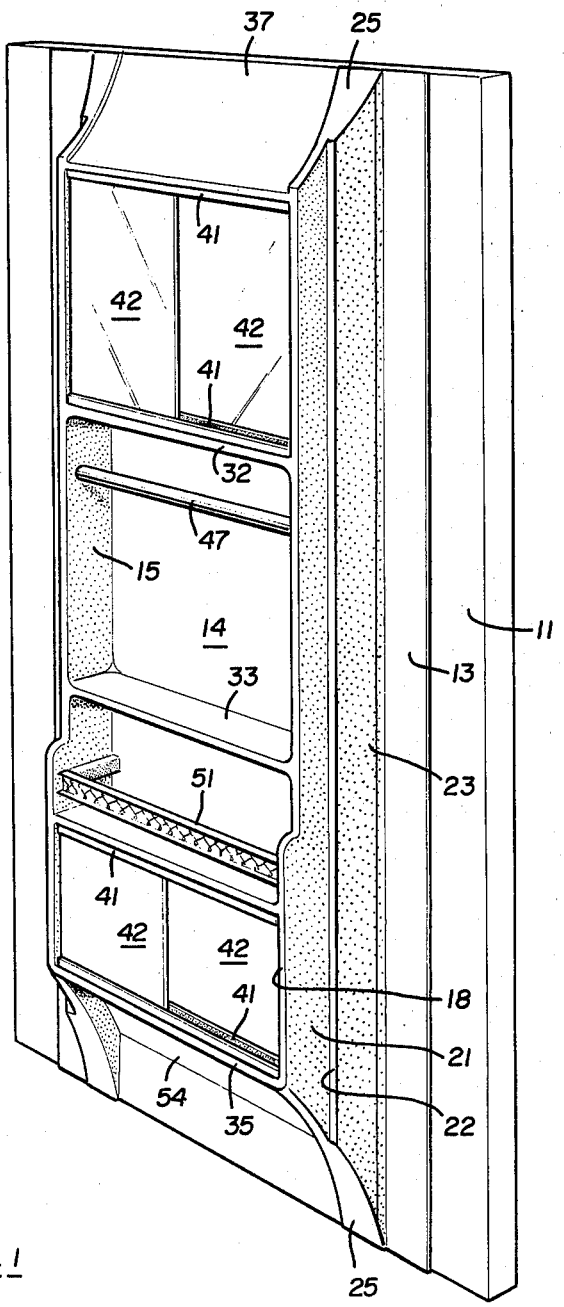
FIG. 1 is a perspective view, with parts shown in elevation, of the storage unit of applicant's invention.
Figure 4:
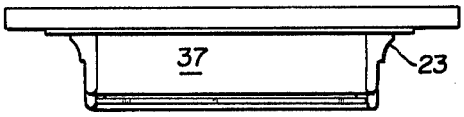
FIG. 4 is a plan view of the storage unit of FIG. 1.
Figure 2:
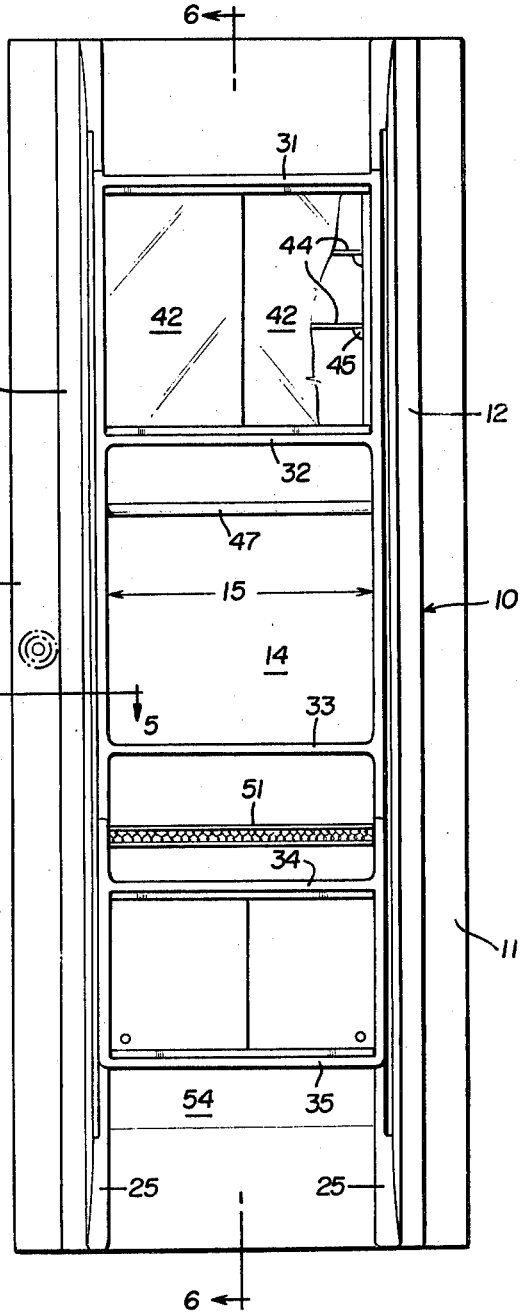
FIG. 2 is a front view of the unit of FIG. 1.
Figure 3:
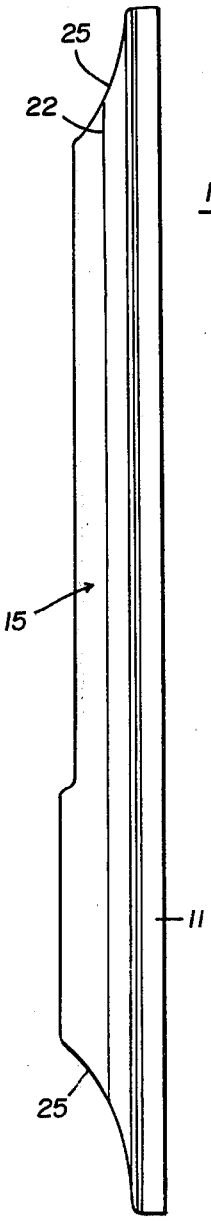
FIG. 3 is a side elevational view of the storage unit of FIG. 1.

As shown in FIGS. 1 through 3, a storage unit 10 of the present invention is adapted to be mounted on a door 11 of the standard, interior, flush-type having planar exterior surfaces. Of course, the unit 10 can be applied to any planar support surface, but it is intended primarily to serve as a supplemental household storage unit attached to one surface of a flush door, such as the door 11.

The unit 10 is preferably formed from thermoplastic material, such as an ABS-styrene copolymer, although other thermoplastic materials, such as polyethylene, polypropylene, nylon, polystyrene polymers, etc. maybe utilized if desired. In the formation of the unit 10, the unit is preferably thermoformed, as by vacuum forming from a single sheet of the desired thermoplastic material, although the unit maybe injection molded, rotationally molded, or made by any other desired fabricating technique.

The unit 10 is formed by a sheet having an initial planar configuration and preferably the original planar sheet forms vertical side strips 12, 13 and a central portion 14 of the unit 10. In other words, these portions of the unit 10 are not appreciably deformed during the thermoforming operation and retain the initial planar configuration of the sheet from which the unit 10 is made.

During thermoforming, a pair of vertically extending side rails indicated generally at 15 are formed. As illustrated in FIGS. 1, 2 and 3, these side rails 15 extend substantially throughout the vertical extent of the unit, which is substantially the same as the vertical extent of the door 11 in a preferred embodiment of the invention, and the side rails are elevated from the plane of the sheet, as determined by the side strips, 12, 13 and the central portion 14.

Figure 5:
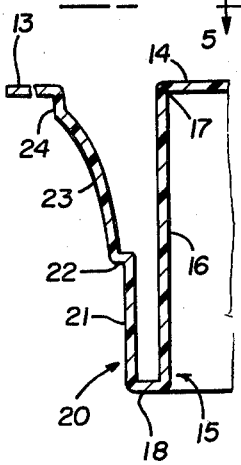
FIG. 5 is a sectional view taken along the plane 5—5 of FIG. 2.

The side rails 15 are, throughout most of their length, of the configuration illustrated in FIG. 5 of the drawings. The rails 15 have planar interior walls 16 which are joined to the planar interior surface 14 integrally through corners 17 of minimal curvature, and the walls 16 extend substantially normal to the surface 14, with some slight allowance for draft to insure ready release of the thermoformed unit 10 from the thermoforming mold. The interior walls 16 merge into joining portions 18 which define the outer rail surface and which are planar, which lie parallel to the plane of the sheet 14, and which are of a relatively small transverse dimension.

The outer rail wall 20 generally flares outwardly from the joining portion 18 to the edge strip 13 of the unit 10. The wall 20 comprises, in a preferred embodiment, a first portion 21 parallel to the inner wall 16, an outwardly projecting flange 22, a concave outwardly extending wall portion 23 and a second flange 24 which is normal to the planar strip portion 13. This preferred embodiment of the wall 20 is provided with the flanges 22, 24 and with the concave portion 23 to increase the rigidity of the wall through radical changes in the shape of the sidewall. If desired, the wall 20 may, for the same purpose, extend from the joining portion 18 to the side strip 13 in a single concave shape, or the wall 20 may assume any other desired configuration, so long as it does generally flare outwardly to provide a greater measure of structural rigidity than would be obtained if it simply extended parallel to the inner wall 16.

Figure 6:
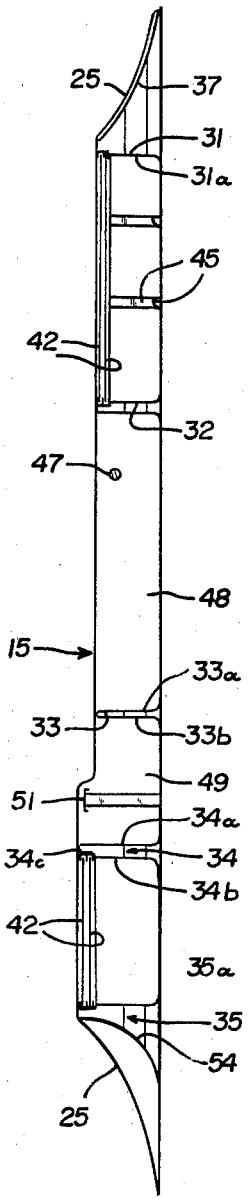
FIG. 6 is a vertical sectional view taken along the plane 6—6 of FIG. 2.
Figure 7:
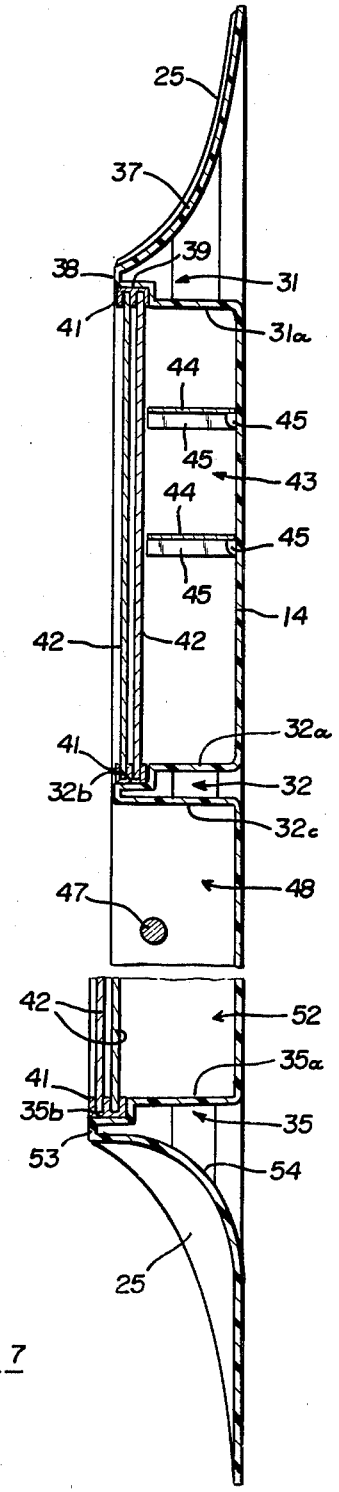
FIG. 7 is a vertical sectional view similar to FIG. 5, but on an enlarged scale and with parts broken away.

The upper and lower extremities of the rails 15 are generally concave, as best seen in FIGS. 1, 3 and 6. At the ends 25 of the rails 15, the dimension of the rails normal to the plane of the sheet or normal to the plane of the support surface 11 diminishes in a smooth, unbroken, arcuate, concave configuration to terminate in the plane of the support surface 11 at each extremity of the unit 10. Of course, these portions 25 of the rails maybe given additional contour, depending upon the aesthetic appearance desired. However, the height of the rails 15 diminishes at each end, so that the entire back of the unit 10 is planar.

The unit 10 is provided with a plurality of laterally extending, parallel ribs 31, 32, 33, 34 and 35. Each of these ribs extends horizontally and is integrally joined at its transverse ends to the side rails 15, so that the ribs subdivide the space intermediate the rails 15 into convenient, vertically stacked storage areas. The ribs 32, 33 and 34 are of generally rectangular configuration with both their top and bottom surfaces horizontal.

The under surface 31*a* of the upper rib is horizontal, but the upper surface 37 thereof is of concave configuration and is upwardly elongated so that the free upper edge thereof blends smoothly into the plane of the sheet, i.e. the plane of the marginal strips 13 and of the central portion 14. The upper surface 37 of the upper rib 31 terminates at the upper edge of the unit. The lower edge of the upper surface 37 of the rib 31 joins the lower rib surface 31*a* through a vertical surface 38 and a downwardly opening recess 39. The next lower rib 32 has its upper surface 32*a* horizontal and provided an upwardly opening recess 32*b* which is vertically aligned with the recess 39 of the rib 31. Positioned in the recesses 39 and 32*b* are elongated guide strips 41 for supporting and guiding sliding door sections 42 closing off the compartment 43 which is enclosed between the lower rib surface 31*a*, the upper rib surface 32*a*, and the interior surfaces 16 of the two side rails 15. The space 43 can be further divided by removable planar shelves 44 which are supported on shelf supports 45 adhesively or otherwise secured to the rail surfaces 16 and to the central portion 14 which define the space 41.

The under surface 32*c* of the rib 32 and the upper surface 33*a* of the rib 33 cooperatively define a second storage space 48 therebetween, this space being traversed by an upper towel bar 47, from which a towel can be pinned freely into the space 46.

A third space 49 is provided intermediate the undersurface 33*b* of the rib 33 and an upper surface 34*a* of the rib 34. It will be noted that the height of the side rail 15 changes at the location of the compartment 49 so that the rib surface 34*a* defines a larger support surface than the equivalent surface 33*a* of the rib 33, and the storage space 49 is of greater depth than are the storage spaces 43 and 48. A retention bar 51 is secured to the inner surfaces 16 of the respective side rails 15 to project therebetween above the rib surface 34*a* to retain articles, such as toilet paper, or the like on the surface 34*a*. The retention bar 51 is secured to the side rails 15 in any desired fashion, as is well known in the prior art in the refrigeration door art and elsewhere.

The outer terminal portion of the undersurface 34*b* of the rib 34 is provided with a recess 34*c* and the upper surface 35*a* of the rib 35 is provided with a recess 35*b* to receive mounting strips 41 which are the same as those above described and which are adhesively secured in place to support sliding doors 42, as also above described, enclosing a lower compartment 54. The outermost end 53 of the rib 35 is joined by a concave joining portion 54 to the plane of the rear wall 14 of the unit to provide an extensive rear surface area which is co-planar with the back 14 of the unit.

To mount the unit 10 on the door 11, it is only necessary to apply adhesive to the back surface 14 of the unit and then place the unit in contact with the exposed flush surface of the door 11. The back surface of the unit exposes an appreciable planar surface area for the reception of the adhesive through which adhesion to the door can be obtained. The only portions of the unit which cannot be so adhered are those which are deflected from the plane of the back of the unit, i.e. the two side rails 15, the ribs 31–35 and the concave undersurfaces or portions 37 and 54. Thus, since the concave portions 37 and 54 merge into the plane of the back of the unit, and the side strips 12 are provided, the entire perimeter of the unit can be adhesively secured to the support surface provided by the door surface. Additionally, the backs of each of the compartments can be adhesively secured to the support surface, since they are co-planar with the perimeter of the unit.

The concave portion 37, structurally a part of the rib 31, together with the rail 25 raised thereabove, provides a tension support which aids in holding the rib 31 in place and stabilizes the upper portion of the unit. The lower concave portion 54, together with the rail portion 25, forms a lower a lower compression strut which aids in supporting the lowermost rib 35 and the entire unit, including any load on the shelf surfaces provided by the ribs.

While the unit 10 has been illustrated as a bathroom storage unit or the like having sliding doors, enclosed compartments and the like, it will be appreciated that the basic unit can be provided as a kitchen unit having only a plurality of shelves, or as a supplementary closet having full length doors, or in any other desired functional storage arrangement.

I claim:

1. A storage unit for attachment to a planar support surface comprising a unitary sheet of thermoplastic material having a pair of parallel, transversely spaced rails projecting normally from a planar backing sheet and extending vertically through the entire extent of said sheet, at least two horizontal ribs of substantially rectangular cross section and integrally formed with said sheet to join said rails, the vertical edges of said sheet and said sheet material intermediate said rails and said ribs being co-planar, an uppermost one of said ribs joining said rails and having a horizontal lower surface and a top surface which is of concave configuration to terminate at its upper extremity at the plane of said sheet edges, and a lowermost one of said ribs joining said rails and having a horizontal upper surface and a bottom surface which is of concave configuration to terminate at its lower extremity at the plane of said sheet edges.

2. A storage unit adapted to be applied to one planar surface of a standard interior door of the flush type, comprising a single sheet of thermoplastic material having one surface thereof permanently thermoformed to provide a central planar portion and a pair of planar edge portions, said portions being co-planar; a pair of spaced, vertically extending side rails integrally formed from said sheet, said rails being interposed between said central planar portion and said planar edge portions to extend throughout substantially the height of the panel and of said door, said side rails having confronting inner faces which are planar and parallel and which lie substantially normal to the plane of said center portion, and said side rails having oppositely directed outer faces which flare outwardly to merge into said planar edge portions; a plurality of horizontal ribs integrally formed from said sheet to extend between and to join said side rails; and concave upper and lower sheet portions intermediate the rails and merging the extreme upper and lower ribs, respectively, into the plane of said central portion, said rails at their extreme upper and lower ends also being concave and being substantially raised from the concave upper and lower intermediate portions to continue the rails to the upper and lower extremities of said unit.

3. A storage unit for application to one planar surface of a standard door of the flush type, comprising a pair of vertical side rails and upper and lower horizontal joining portions integrally formed with said side rails, said rails and said upper and lower portions being adapted to project normally to said door for cooperatively surrounding a centrally located storage space, an interior planar backing element for said storage space integral with said rails and with said joining portions and a pair of vertical planar edge strips exterior to said space and each integral with the adjacent one of said rails, the exterior surface of each rail flaring outwardly to merge into the adjacent one of said strips, so that the rails broaden at their bases, upper and lower central portions integral with said upper and lower joining portions, respectively, said central portions being concave to merge said joining portions into the plane of said backing element, and said rails each having concave upper and lower concave extremities, and said planar backing element, said edge elements, and the joining portions at the plane of the backing element all being adapted to receive an adhesive on their reverse surfaces to secure the unit to the planar surface of a door.

4. A storage unit for application to a planar support surface comprising an initially planar, unitary sheet of thermoplastic material which has been thermoformed to provide a pair of laterally spaced vertical side rails and a plurality of parallel horizontal ribs joining the side rails, said side rails being parallel to one another and being deflected from the plane of the sheet to extend vertically throughout the vertical dimension of said sheet, said rails each having a vertical intermediate portion, a concave upper end portion and a concave lower end portion, said ribs having their ends joined to the rails respectively, the uppermost of said ribs being located substantially at the juncture of the rail upper and intermediate portions and having an upper concave surface joining the uppermost rib to the plane of the sheet, and the lowermost of said ribs being located substantially at the juncture of the rail lower and intermediate portions and having a lower concave surface joining the lowermost rib to the plane of the sheet, said upper concave surfaces of said rails and of said uppermost rib serving as tension members supporting said rails, said ribs and any load thereon, and said lower concave surfaces of said rails and said lowermost rib serving as a compression strut supporting said rails, said ribs and any load thereon, said rails and said ribs being formed entirely on one surface of said sheet, with the planar portions of the reverse surface of said sheet being adapted to have adhesive applied thereto for adhering said sheet to a planar support surface.

5. A storage unit adapted to be applied to a planar support surface comprising a single sheet of thermoformed thermoplastic material having one surface thereof permanently thermoformed to provide a central planar portion and planar vertical edge portion, said portions being co-planar; a pair of spaced, vertically extending side rails integrally formed from said sheet, said rails each being interposed between said central planar portion and one of said planar edge portions to extend throughout substantially the entire height of the panel and of said door; a plurality of horizontal joining portions integrally formed from said sheet to extend between and to join said side rails; and concave upper and lower portions bridging the rails and merging the extreme upper and lower joining portions, respectively, into the plane of said central portion.

6. A storage unit for application to a planar support surface comprising a pair of vertical side rails and upper and lower horizontal ribs integrally formed with said side rails, said rails and said upper and lower ribs being adapted to project normally to said support surface; an interior planar backing portion integral with said rails and with said ribs and lying intermediate said ribs and said rails; and a pair of vertical planar strips outside said rails and each integral with the adjacent one of said rails, the exterior surface of each rail flaring outwardly to merge into the adjacent one of said strips and being adapted to receive an adhesive on the planar reverse surfaces thereof to secure the unit to the planar surface of a door.

7. A storage unit for application to a planar support surface comprising an initially planar, unitary sheet of thermoplastic material which has been thermoformed to provide a pair of laterally spaced vertical side rails and a plurality of parallel horizontal shelves joining the side rails, said side rails being parallel to one another and extending vertically throughout the entire vertical dimension of said sheet, said upper portions of said rails and said uppermost shelf serving as tension members supporting said rails, said shelves and any load thereon, said lower portions of said rails and said lowermost shelf serving as a compression strut supporting said rails, said shelves and any load thereon, said rails and said shelves being formed entirely on one surface of said sheet, with the planar portions of the reverse surface of said sheet being adapted to have adhesive applied thereto for adhering said sheet to a planar support surface.

8. A storage unit for attachment to a planar support surface comprising a unitary sheet of thermoplastic material having a pair of parallel, transversely spaced rails projecting normally from a planar backing sheet and extending vertically throughout the entire extent of said sheet, a plurality of horizontal ribs integrally formed with said sheet to join said rails, said ribs with the exception of the uppermost rib having upper surfaces serving as shelves bridging said rails, the vertical edges of said sheet and said sheet material intermediate said rails and said rib being co-planar, the uppermost of said ribs joining said rails and having a top surface which terminates at its upper extremity at the plane of said sheet edges, and the lowermost of said ribs joining said rails and having a bottom surface which terminates at its lower extremity at the plane of said sheet edges.

9. A storage unit as defined in claim 8, wherein a towel bar extends horizontally between said rails with its ends entered, respectively, in apertures in said rails.

10. A storage unit as defined in claim 8, wherein a retention member is secured at its ends to the confronting interior surfaces of said rails to project therebetween in proximity to one of said ribs.

* * * * *